US011931855B2

(12) United States Patent
Chen et al.

(10) Patent No.: US 11,931,855 B2
(45) Date of Patent: Mar. 19, 2024

(54) PLANARIZATION METHODS FOR PACKAGING SUBSTRATES

(71) Applicant: Applied Materials, Inc., Santa Clara, CA (US)

(72) Inventors: Han-Wen Chen, Cupertino, CA (US); Steven Verhaverbeke, San Francisco, CA (US); Tapash Chakraborty, Maharashtra (IN); Prayudi Lianto, Singapore (SG); Prerna Sonthalia Goradia, Mumbai (IN); Giback Park, San Jose, CA (US); Chintan Buch, Santa Clara, CA (US); Pin Gian Gan, Singapore (SG); Alex Hung, Singapore (SG)

(73) Assignee: Applied Materials, Inc., Santa Clara, CA (US)

( * ) Notice: Subject to any disclaimer, the term of this patent is extended or adjusted under 35 U.S.C. 154(b) by 458 days.

(21) Appl. No.: 16/885,753

(22) Filed: May 28, 2020

(65) Prior Publication Data

US 2020/0391343 A1 Dec. 17, 2020

(30) Foreign Application Priority Data

Jun. 17, 2019 (IN) ..... 201941023935

(51) Int. Cl.
*B24B 37/04* (2012.01)
*B24B 21/04* (2006.01)
(Continued)

(52) U.S. Cl.
CPC ..... *B24B 37/042* (2013.01); *B24B 21/04* (2013.01); *B24B 37/14* (2013.01); *B24B 37/07* (2013.01)

(58) Field of Classification Search
CPC ..... B24B 37/042; B24B 37/14; B24B 37/07; B24B 21/04
(Continued)

(56) References Cited

U.S. PATENT DOCUMENTS 4,073,610 A 2/1978 Cox
5,126,016 A 6/1992 Glenning et al.
(Continued)

FOREIGN PATENT DOCUMENTS

CA 2481616 C 1/2013
CN 1646650 A * 7/2005 ..... C09G 1/02
(Continued)

OTHER PUBLICATIONS

English translation of CN1646650A by Google Patents (Year: 2005).*
(Continued)

*Primary Examiner* — Joel D Crandall
*Assistant Examiner* — Sukwoo James Chang
(74) *Attorney, Agent, or Firm* — Patterson + Sheridan, LLP

(57) ABSTRACT

Embodiments of the present disclosure generally relate to planarization of surfaces on substrates and on layers formed on substrates. More specifically, embodiments of the present disclosure relate to planarization of surfaces on substrates for advanced packaging applications, such as surfaces of polymeric material layers. In one implementation, the method includes mechanically grinding a substrate surface against a polishing surface in the presence of a grinding slurry during a first polishing process to remove a portion of a material formed on the substrate; and then chemically mechanically polishing the substrate surface against the polishing surface in the presence of a polishing slurry during
(Continued)

a second polishing process to reduce any roughness or unevenness caused by the first polishing process.

20 Claims, 2 Drawing Sheets

(51) Int. Cl.
*B24B 37/07* (2012.01)
*B24B 37/14* (2012.01)

(58) Field of Classification Search
USPC ..... 451/41
See application file for complete search history.

(56) References Cited

U.S. PATENT DOCUMENTS 5,268,194 A 12/1993 Kawakami et al.
5,353,195 A 10/1994 Fillion et al.
5,367,143 A 11/1994 White, Jr.
5,374,788 A 12/1994 Endoh et al.
5,474,834 A 12/1995 Tanahashi et al.
5,670,262 A 9/1997 Dalman
5,767,480 A 6/1998 Anglin et al.
5,783,870 A 7/1998 Mostafazadeh et al.
5,841,102 A 11/1998 Noddin
5,878,485 A 3/1999 Wood et al.
6,039,889 A 3/2000 Zhang et al.
6,087,719 A 7/2000 Tsunashima
6,117,704 A 9/2000 Yamaguchi et al.
6,211,485 B1 4/2001 Burgess
6,384,473 B1 5/2002 Peterson et al.
6,388,202 B1 5/2002 Swirbel et al.
6,388,207 B1 5/2002 Figueroa et al.
6,459,046 B1 10/2002 Ochi et al.
6,465,084 B1 10/2002 Curcio et al.
6,489,670 B1 12/2002 Peterson et al.
6,495,895 B1 12/2002 Peterson et al.
6,506,632 B1 1/2003 Cheng et al.
6,512,182 B2 1/2003 Takeuchi et al.
6,538,312 B1 3/2003 Peterson et al.
6,555,906 B2 4/2003 Towle et al.
6,576,869 B1 6/2003 Gower et al.
6,593,240 B1 7/2003 Page
6,631,558 B2 10/2003 Burgess
6,661,084 B1 12/2003 Peterson et al.
6,713,719 B1 3/2004 De Steur et al.
6,724,638 B1 4/2004 Inagaki et al.
6,775,907 B1 8/2004 Boyko et al.
6,781,093 B2 8/2004 Conlon et al.
6,799,369 B2 10/2004 Ochi et al.
6,894,399 B2 5/2005 Vu et al.
7,028,400 B1 4/2006 Hiner et al.
7,062,845 B2 6/2006 Burgess
7,064,069 B2 6/2006 Draney et al.
7,078,788 B2 7/2006 Vu et al.
7,091,589 B2 8/2006 Mori et al.
7,091,593 B2 8/2006 Ishimaru et al.
7,105,931 B2 9/2006 Attarwala
7,129,117 B2 10/2006 Hsu
7,166,914 B2 1/2007 DiStefano et al.
7,170,152 B2 1/2007 Huang et al.
7,192,807 B1 3/2007 Huemoeller et al.
7,211,899 B2 5/2007 Taniguchi et al.
7,271,012 B2 9/2007 Anderson
7,274,099 B2 9/2007 Hsu
7,276,446 B2 10/2007 Robinson et al.
7,279,357 B2 10/2007 Shimoishizaka et al.
7,312,405 B2 12/2007 Hsu
7,321,164 B2 1/2008 Hsu
7,449,363 B2 11/2008 Hsu
7,458,794 B2 12/2008 Schwaighofer et al.
7,511,365 B2 3/2009 Wu et al.
7,690,109 B2 4/2010 Mori et al.
7,714,431 B1 5/2010 Huemoeller et al.
7,723,838 B2 5/2010 Takeuchi et al.
7,754,530 B2 7/2010 Wu et al.
7,808,799 B2 10/2010 Kawabe et al.
7,839,649 B2 11/2010 Hsu
7,843,064 B2 11/2010 Kuo et al.
7,852,634 B2 12/2010 Sakamoto et al.
7,855,460 B2 12/2010 Kuwajima
7,868,464 B2 1/2011 Kawabata et al.
7,887,712 B2 2/2011 Boyle et al.
7,914,693 B2 3/2011 Jeong et al.
7,915,737 B2 3/2011 Nakasato et al.
7,932,595 B1 4/2011 Huemoeller et al.
7,932,608 B2 4/2011 Tseng et al.
7,955,942 B2 6/2011 Pagaila et al.
7,978,478 B2 7/2011 Inagaki et al.
7,982,305 B1 7/2011 Railkar et al.
7,988,446 B2 8/2011 Yeh et al.
8,069,560 B2 12/2011 Mori et al.
8,137,497 B2 3/2012 Sunohara et al.
8,283,778 B2 10/2012 Trezza
8,314,343 B2 11/2012 Inoue et al.
8,367,943 B2 2/2013 Wu et al.
8,384,203 B2 2/2013 Toh et al.
8,390,125 B2 3/2013 Tseng et al.
8,426,246 B2 4/2013 Toh et al.
8,476,769 B2 7/2013 Chen et al.
8,518,746 B2 8/2013 Pagaila et al.
8,536,695 B2 9/2013 Liu et al.
8,628,383 B2 1/2014 Starling et al.
8,633,397 B2 1/2014 Jeong et al.
8,698,293 B2 4/2014 Otremba et al.
8,704,359 B2 4/2014 Tuominen et al.
8,710,402 B2 4/2014 Lei et al.
8,710,649 B1 4/2014 Huemoeller et al.
8,728,341 B2 5/2014 Ryuzaki et al.
8,772,087 B2 7/2014 Barth et al.
8,786,098 B2 7/2014 Wang
8,877,554 B2 11/2014 Tsai et al.
8,890,628 B2 11/2014 Nair et al.
8,907,471 B2 12/2014 Beyne et al.
8,921,995 B1 12/2014 Railkar et al.
8,952,544 B2 2/2015 Lin et al.
8,980,691 B2 3/2015 Lin
8,990,754 B2 3/2015 Bird et al.
8,994,185 B2 3/2015 Lin et al.
8,999,759 B2 4/2015 Chia
9,059,186 B2 6/2015 Shim et al.
9,064,936 B2 6/2015 Lin et al.
9,070,637 B2 6/2015 Yoda et al.
9,099,313 B2 8/2015 Lee et al.
9,111,914 B2 8/2015 Lin et al.
9,142,487 B2 9/2015 Toh et al.
9,159,678 B2 10/2015 Cheng et al.
9,161,453 B2 10/2015 Koyanagi
9,210,809 B2 12/2015 Mallik et al.
9,224,674 B2 12/2015 Malatkar et al.
9,275,934 B2 3/2016 Sundaram et al.
9,318,376 B1 4/2016 Holm et al.
9,355,881 B2 5/2016 Goller et al.
9,363,898 B2 6/2016 Tuominen et al.
9,396,999 B2 7/2016 Yap et al.
9,406,645 B1 8/2016 Huemoeller et al.
9,499,397 B2 11/2016 Bowles et al.
9,530,752 B2 12/2016 Nikitin et al.
9,554,469 B2 1/2017 Hurwitz et al.
9,660,037 B1 5/2017 Zechmann et al.
9,698,104 B2 7/2017 Yap et al.
9,704,726 B2 7/2017 Toh et al.
9,735,134 B2 8/2017 Chen
9,748,167 B1 8/2017 Lin
9,754,849 B2 9/2017 Huang et al.
9,837,352 B2 12/2017 Chang et al.
9,837,484 B2 12/2017 Jung et al.
9,859,258 B2 1/2018 Chen et al.
9,875,970 B2 1/2018 Yi et al.
9,887,103 B2 2/2018 Scanlan et al.
9,887,167 B1 2/2018 Lee et al.
9,893,045 B2 2/2018 Pagaila et al.
9,978,720 B2 5/2018 Theuss et al.

(56) References Cited

U.S. PATENT DOCUMENTS 9,997,444 B2 6/2018 Meyer et al.
10,014,292 B2 7/2018 Or-Bach et al.
10,037,975 B2 7/2018 Hsieh et al.
10,053,359 B2 8/2018 Bowles et al.
10,090,284 B2 10/2018 Chen et al.
10,109,588 B2 10/2018 Jeong et al.
10,128,177 B2 11/2018 Kamgaing et al.
10,153,219 B2 12/2018 Jeon et al.
10,163,803 B1 12/2018 Chen et al.
10,170,386 B2 1/2019 Kang et al.
10,177,083 B2 1/2019 Kim et al.
10,211,072 B2 2/2019 Chen et al.
10,229,827 B2 3/2019 Chen et al.
10,256,180 B2 4/2019 Liu et al.
10,269,773 B1 4/2019 Yu et al.
10,297,518 B2 5/2019 Lin et al.
10,297,586 B2 5/2019 Or-Bach et al.
10,304,765 B2 5/2019 Chen et al.
10,347,585 B2 7/2019 Shin et al.
10,410,971 B2 9/2019 Rae et al.
10,424,530 B1 9/2019 Alur et al.
10,515,912 B2 12/2019 Lim et al.
10,522,483 B2 12/2019 Shuto
10,553,515 B2 2/2020 Chew
10,570,257 B2 2/2020 Sun et al.
10,658,337 B2 5/2020 Yu et al.
2001/0020548 A1 9/2001 Burgess
2001/0030059 A1 10/2001 Sugaya et al.
2002/0036054 A1 3/2002 Nakatani et al.
2002/0048715 A1 4/2002 Walczynski
2002/0070443 A1 6/2002 Mu et al.
2002/0074615 A1 6/2002 Honda
2002/0135058 A1 9/2002 Asahi et al.
2002/0158334 A1 10/2002 Vu et al.
2002/0170891 A1 11/2002 Boyle et al.
2003/0059976 A1 3/2003 Nathan et al.
2003/0221864 A1 12/2003 Bergstedt et al.
2003/0222330 A1 12/2003 Sun et al.
2004/0080040 A1 4/2004 Dotta et al.
2004/0118824 A1 6/2004 Burgess
2004/0134682 A1 7/2004 En et al.
2004/0248412 A1 12/2004 Liu et al.
2005/0012217 A1 1/2005 Mori et al.
2005/0170292 A1 8/2005 Tsai et al.
2006/0014532 A1 1/2006 Seligmann et al.
2006/0073234 A1 4/2006 Williams
2006/0128069 A1 6/2006 Hsu
2006/0145328 A1 7/2006 Hsu
2006/0160332 A1 7/2006 Gu et al.
2006/0270242 A1 11/2006 Verhaverbeke et al.
2006/0283716 A1 12/2006 Hafezi et al.
2007/0035033 A1 2/2007 Ozguz et al.
2007/0042563 A1 2/2007 Wang et al.
2007/0077865 A1 4/2007 Dysard et al.
2007/0111401 A1 5/2007 Kataoka et al.
2007/0130761 A1 6/2007 Kang et al.
2008/0006945 A1 1/2008 Lin et al.
2008/0011852 A1 1/2008 Gu et al.
2008/0090095 A1 4/2008 Nagata et al.
2008/0113283 A1 5/2008 Ghoshal et al.
2008/0119041 A1 5/2008 Magera et al.
2008/0173792 A1 7/2008 Yang et al.
2008/0173999 A1 7/2008 Chung et al.
2008/0293332 A1* 11/2008 Watanabe ..... B24B 37/26 451/527
2008/0296273 A1 12/2008 Lei et al.
2009/0084596 A1 4/2009 Inoue et al.
2009/0243065 A1 10/2009 Sugino et al.
2009/0250823 A1 10/2009 Racz et al.
2009/0278126 A1 11/2009 Yang et al.
2010/0013081 A1 1/2010 Toh et al.
2010/0062287 A1 3/2010 Beresford et al.
2010/0062687 A1* 3/2010 Oh ..... C01F 17/235 451/41
2010/0144101 A1 6/2010 Chow et al.
2010/0148305 A1 6/2010 Yun
2010/0160170 A1 6/2010 Horimoto et al.
2010/0248451 A1 9/2010 Pirogovsky et al.
2010/0264538 A1 10/2010 Swinnen et al.
2010/0301023 A1 12/2010 Unrath et al.
2010/0307798 A1 12/2010 Izadian
2011/0062594 A1 3/2011 Maekawa et al.
2011/0097432 A1 4/2011 Yu et al.
2011/0111300 A1 5/2011 DelHagen et al.
2011/0204505 A1 8/2011 Pagaila et al.
2011/0259631 A1 10/2011 Rumsby
2011/0291293 A1 12/2011 Tuominen et al.
2011/0304024 A1 12/2011 Renna
2011/0316147 A1 12/2011 Shih et al.
2012/0128891 A1 5/2012 Takei et al.
2012/0146209 A1 6/2012 Hu et al.
2012/0164827 A1 6/2012 Rajagopalan et al.
2012/0261805 A1 10/2012 Sundaram et al.
2013/0074332 A1 3/2013 Suzuki
2013/0105329 A1 5/2013 Matejat et al.
2013/0196501 A1 8/2013 Sulfridge
2013/0203190 A1 8/2013 Reed et al.
2013/0286615 A1 10/2013 Inagaki et al.
2013/0341738 A1 12/2013 Reinmuth et al.
2014/0054075 A1 2/2014 Hu
2014/0092519 A1 4/2014 Yang
2014/0094094 A1 4/2014 Rizzuto et al.
2014/0103499 A1 4/2014 Andry et al.
2014/0252655 A1 9/2014 Tran et al.
2014/0353019 A1 12/2014 Arora et al.
2015/0228416 A1 8/2015 Hurwitz et al.
2015/0296610 A1 10/2015 Daghighian et al.
2015/0311093 A1 10/2015 Li et al.
2015/0359098 A1 12/2015 Ock
2015/0380356 A1 12/2015 Chauhan et al.
2016/0013135 A1 1/2016 He et al.
2016/0020163 A1 1/2016 Shimizu et al.
2016/0049371 A1 2/2016 Lee et al.
2016/0088729 A1 3/2016 Kobuke et al.
2016/0095203 A1 3/2016 Min et al.
2016/0118337 A1 4/2016 Yoon et al.
2016/0270242 A1 9/2016 Kim et al.
2016/0276325 A1 9/2016 Nair et al.
2016/0329299 A1 11/2016 Lin et al.
2016/0336296 A1 11/2016 Jeong et al.
2017/0047308 A1 2/2017 Ho et al.
2017/0064835 A1 3/2017 Ishihara et al.
2017/0223842 A1 8/2017 Chujo et al.
2017/0229432 A1 8/2017 Lin et al.
2017/0338254 A1 11/2017 Reit et al.
2018/0019197 A1 1/2018 Boyapati et al.
2018/0116057 A1 4/2018 Kajihara et al.
2018/0182727 A1 6/2018 Yu
2018/0197831 A1 7/2018 Kim et al.
2018/0204802 A1 7/2018 Lin et al.
2018/0308792 A1 10/2018 Raghunathan et al.
2018/0352658 A1 12/2018 Yang
2018/0374696 A1 12/2018 Chen et al.
2018/0376589 A1 12/2018 Harazono
2019/0088603 A1 3/2019 Marimuthu et al.
2019/0131224 A1 5/2019 Choi et al.
2019/0131270 A1 5/2019 Lee et al.
2019/0131284 A1 5/2019 Jeng et al.
2019/0189561 A1 6/2019 Rusli
2019/0229046 A1 7/2019 Tsai et al.
2019/0237430 A1 8/2019 England
2019/0285981 A1 9/2019 Cunningham et al.
2019/0306988 A1 10/2019 Grober et al.
2019/0355680 A1 11/2019 Chuang et al.
2019/0369321 A1 12/2019 Young et al.
2020/0003936 A1 1/2020 Fu et al.
2020/0039002 A1 2/2020 Sercel et al.
2020/0130131 A1 4/2020 Togawa et al.

(56) References Cited

U.S. PATENT DOCUMENTS

| | | | |
|---|---|---|---|
| 2020/0357947 | A1 | 11/2020 | Chen et al. |
| 2020/0358163 | A1 | 11/2020 | See et al. |

FOREIGN PATENT DOCUMENTS

| | | | | | |
|---|---|---|---|---|---|
| CN | 1971894 | A | | 5/2007 | |
| CN | 100463128 | C | | 2/2009 | |
| CN | 100502040 | C | | 6/2009 | |
| CN | 100524717 | C | | 8/2009 | |
| CN | 100561696 | C | | 11/2009 | |
| CN | 102449747 | A | * | 5/2012 | ..... C09K 3/1463 |
| CN | 104637912 | A | | 5/2015 | |
| CN | 105436718 | A | | 3/2016 | |
| CN | 106531647 | A | | 3/2017 | |
| CN | 106653703 | A | | 5/2017 | |
| CN | 107428544 | A | | 12/2017 | |
| CN | 108028225 | A | | 5/2018 | |
| CN | 109155246 | A | | 1/2019 | |
| CN | 111492472 | A | | 8/2020 | |
| EP | 0264134 | A2 | | 4/1988 | |
| EP | 1536673 | A1 | | 6/2005 | |
| EP | 1478021 | B1 | | 7/2008 | |
| EP | 1845762 | B1 | | 5/2011 | |
| EP | 2942808 | A1 | | 11/2015 | |
| JP | 2001244591 | A | | 9/2001 | |
| JP | 2002246755 | A | | 8/2002 | |
| JP | 2003188340 | A | | 7/2003 | |
| JP | 2004311788 | A | | 11/2004 | |
| JP | 2004335641 | A | | 11/2004 | |
| JP | 4108285 | B2 | | 6/2008 | |
| JP | 2012069926 | A | | 4/2012 | |
| JP | 5004378 | B2 | | 8/2012 | |
| JP | 5111342 | B2 | | 1/2013 | |
| JP | 2013176835 | A | | 9/2013 | |
| JP | 5693977 | B2 | | 4/2015 | |
| JP | 5700241 | B2 | | 4/2015 | |
| JP | 5981232 | B2 | | 8/2016 | |
| JP | 2017148920 | A | | 8/2017 | |
| JP | 2017197708 | A | | 11/2017 | |
| JP | 6394136 | B2 | | 9/2018 | |
| JP | 6542616 | B2 | | 7/2019 | |
| JP | 6626697 | B2 | | 12/2019 | |
| KR | 100714196 | B1 | | 5/2007 | |
| KR | 100731112 | B1 | | 6/2007 | |
| KR | 10-2008-0037296 | A | | 4/2008 | |
| KR | 2008052491 | A | | 6/2008 | |
| KR | 20100097893 | A | | 9/2010 | |
| KR | 20120130851 | A | * | 12/2012 | ..... B24B 37/04 |
| KR | 101301507 | B1 | | 9/2013 | |
| KR | 20140086375 | A | | 7/2014 | |
| KR | 101494413 | B1 | | 2/2015 | |
| KR | 20160013706 | A | | 2/2016 | |
| KR | 20180113885 | A | | 10/2018 | |
| KR | 101922884 | B1 | | 11/2018 | |
| KR | 101975302 | B1 | | 8/2019 | |
| KR | 102012443 | B1 | | 8/2019 | |
| TW | 201030832 | A | * | 8/2010 | ..... B24B 37/00 |
| TW | 201042019 | A | | 12/2010 | |
| TW | I594397 | B | | 8/2017 | |
| TW | 201805400 | A | * | 2/2018 | ..... B24B 37/044 |
| WO | WO2011080912 | A1 | * | 7/2011 | ..... B24B 1/00 |
| WO | 2011130300 | A1 | | 10/2011 | |
| WO | 2013008415 | A1 | | 1/2013 | |
| WO | 2013126927 | A2 | | 8/2013 | |
| WO | WO2014208270 | A1 | * | 12/2014 | ..... B24B 37/28 |
| WO | 2015126438 | A1 | | 8/2015 | |
| WO | 2016143797 | A | | 9/2016 | |
| WO | 2017111957 | A1 | | 6/2017 | |
| WO | 2018013122 | A1 | | 1/2018 | |
| WO | 2018125184 | A1 | | 7/2018 | |
| WO | 2019023213 | A1 | | 1/2019 | |
| WO | 2019066988 | A1 | | 4/2019 | |
| WO | 2019/177742 | A1 | | 9/2019 | |

OTHER PUBLICATIONS

English translation of KR100731112 by Google Patents (Year: 2007).*
English translation of CN102449747A (Year: 2012).*
English translation of WO2014208270A1 by Google Patents (Year: 2014).*
English translation of TW201805400A (Year: 2018).*
English translation of KR20120130851A (Year: 2012).*
English translation of WO2011080912A1 (Year: 2011).*
English translation of TW 201030832A (Year: 2010).*
Taiwan Office Action dated Feb. 25, 2022, for Taiwan Patent Application No. 109119795.
PCT International Search Report and Written Opinion dated Feb. 4, 2022, for International Application No. PCT/ US2021/053830.
PCT International Search Report and Written Opinion dated Feb. 4, 2022, for International Application No. PCT/US2021/053821.
International Search Report and Written Opinion dated Oct. 7, 2021 for Application No. PCT/US2021037375.
PCT International Search Report and Written Opinion dated Oct. 19, 2021, for International Application No. PCT/US2021/038690.
PCT International Search Report and Written Opinion dated Feb. 17, 2021 for International Application No. PCT/US2020/057787.
PCT International Search Report and Written Opinion dated Feb. 19, 2021, for International Application No. PCT/US2020/057788.
U.S. Office Action dated May 13, 2021, in U.S. Appl. No. 16/870,843.
Chen, Qiao—"Modeling, Design and Demonstration of Through-Package-Vias in Panel-Based Polycrystalline Silicon Interposers for High Performance, High Reliability and Low Cost," a Dissertation presented to the Academic Faculty, Georgia Institute of Technology, May 2015, 168 pages.
Annon, John Jr., et al.—"Fabrication and Testing of a TSV-Enabled Si Interposer with Cu- and Polymer-Based Multilevel Metallization," IEEE Transactions on Components, Packaging and Manufacturing Technology, vol. 4, No. 1, Jan. 2014, pp. 153-157.
Malta, D., et al.—"Fabrication of TSV-Based Silicon Interposers," 3D Systems Integration Conference (3DIC), 2010 IEEE International, Nov. 16-18, 2010, 6 pages.
Allresist Gmbh—Strausberg et al.: "Resist-Wiki: Adhesion promoter HMDS and diphenylsilanedio (AR 300-80) - . . . - ALLRESIST GmbH—Strausberg, Germany", Apr. 12, 2019 (Apr. 12, 2019), XP055663206, Retrieved from the Internet: URL:https://web.archive.org/web/2019041220micals-adhesion-promoter-hmds-and-diphenyl2908/https://www.allresist.com/process-chemicals-adhesion-promoter-hmds-and-diphenylsilanedio/, [retrieved on Jan. 29, 2020].
Amit Kelkar, et al. "Novel Mold-free Fan-out Wafer Level Package using Silicon Wafer", IMAPS 2016—49th International Symposium on Microelectronics—Pasadena, CA USA—Oct. 10-13, 2016, 5 pages. (IMAPS 2016—49th International Symposium on Microelectronics—Pasadena, CA USA—Oct. 10-13, 2016, 5 pages.).
Arifur Rahman. "System-Level Performance Evaluation of Three-Dimensional Integrated Circuits", vol. 8, No. 6, Dec. 2000. pp. 671-678.
Baier, T. et al., Theoretical Approach to Estimate Laser Process Parameters for Drilling in Crystalline Silicon, Prog. Photovolt: Res. Appl. 18 (2010) 603-606, 5 pages.
Chien-Wei Chien et al."Chip Embedded Wafer Level Packaging Technology for Stacked RF-SiP Application",2007 IEEE, pp. 305-310.
Doany, F.E., et al.—"Laser release process to obtain freestanding multilayer metal-polyimide circuits," IBM Journal of Research and Development, vol. 41, Issue 1/2, Jan./Mar. 1997, pp. 151-157.
Dyer, P.E., et al.—"Nanosecond photoacoustic studies on ultraviolet laser ablation of organic polymers," Applied Physics Letters, vol. 48, No. 6, Feb. 10, 1986, pp. 445-447.
Han et al.—"Process Feasibility and Reliability Performance of Fine Pitch Si Bare Chip Embedded in Through Cavity of Substrate Core," IEEE Trans. Components, Packaging and Manuf. Tech., vol. 5, No. 4, pp. 551-561, 2015. [Han et al. IEEE Trans. Components, Packaging and Manuf. Tech., vol. 5, No. 4, pp. 551-561, 2015.].
Han et al.—"Through Cavity Core Device Embedded Substrate for Ultra-Fine-Pitch Si Bare Chips; (Fabrication feasibility and residual stress evaluation)", ICEP-IAAC, 2015, pp. 174-179. [Han et al.,

(56) References Cited

OTHER PUBLICATIONS

ICEP-IAAC, 2015, pp. 174-179.].
Han, Younggun, et al.—"Evaluation of Residual Stress and Warpage of Device Embedded Substrates with Piezo-Resistive Sensor Silicon Chips" technical paper, Jul. 31, 2015, pp. 81-94.
International Search Report and the Written Opinion for International Application No. PCT/US2019/064280 dated Mar. 20, 2020, 12 pages.
International Search Report and Written Opinion for Application No. PCT/US2020/026832 dated Jul. 23, 2020.
Italian search report and written opinion for Application No. IT 201900006736 dated Mar. 2, 2020.
Italian Search Report and Written Opinion for Application No. IT 201900006740 dated Mar. 4, 2020.
Junghoon Yeom', et al. "Critical Aspect Ratio Dependence in Deep Reactive Ion Etching of Silicon", 2003 IEEE. pp. 1631-1634.
K. Sakuma et al. "3D Stacking Technology with Low-Volume Lead-Free Interconnections", IBM T.J. Watson Research Center. 2007 IEEE, pp. 627-632.
Kenji Takahashi et al. "Current Status of Research and Development for Three-Dimensional Chip Stack Technology", Jpn. J. Appl. Phys. vol. 40 (2001) pp. 3032-3037, Part 1, No. 4B, Apr. 2001. 6 pages.
Kim et al. "A Study on the Adhesion Properties of Reactive Sputtered Molybdenum Thin Films with Nitrogen Gas on Polyimide Substrate as a Cu Barrier Layer," 2015, Journal of Nanoscience and Nanotechnology, vol. 15, No. 11, pp.8743-8748, doi: 10.1166/jnn.2015.11493.
Knickerbocker, J.U., et al.—"Development of next-generation system-on-package (SOP) technology based on silicon carriers with fine-pitch chip interconnection," IBM Journal of Research and Development, vol. 49, Issue 4/5, Jul./Sep. 2005, pp. 725-753.
Knickerbocker, John U., et al.—"3-D Silicon Integration and Silicon Packaging Technology Using Silicon Through-Vias," IEEE Journal of Solid-State Circuits, vol. 41, No. 8, Aug. 2006, pp. 1718-1725.
Knorz, A. et al., High Speed Laser Drilling: Parameter Evaluation and Characterisation, Presented at the 25th European PV Solar Energy Conference and Exhibition, Sep. 6-10, 2010, Valencia, Spain, 7 pages.
L. Wang, et al. "High aspect ratio through-wafer interconnections for 3Dmicrosystems", 2003 IEEE. pp. 634 -637.
Lee et al. "Effect of sputtering parameters on the adhesion force of copper/molybdenum metal on polymer substrate," 2011, Current Applied Physics, vol. 11, pp. S12-S15, doi: 10.1016/j.cap.2011.06.019.
Liu, C.Y. et al., Time Resolved Shadowgraph Images of Silicon during Laser Ablation: Shockwaves and Particle Generation, Journal of Physics: Conference Series 59 (2007) 338-342, 6 pages.
Narayan, C., et al.—"Thin Film Transfer Process for Low Cost MCM's," Proceedings of 1993 IEEE/CHMT International Electronic Manufacturing Technology Symposium, Oct. 4-6, 1993, pp. 373-380.
NT Nguyen et al. "Through-Wafer Copper Electroplating for Three-Dimensional Interconnects", Journal of Micromechanics and Microengineering. 12 (2002) 395-399. 2002 IOP.
PCT International Search Report and Written Opinion dated Aug. 28, 2020, for International Application No. PCT/US2020/032245.
PCT International Search Report and Written Opinion dated Sep. 15, 2020, for International Application No. PCT/US2020/035778.
Ronald Hon et al. "Multi-Stack Flip Chip 3D Packaging with Copper Plated Through-Silicon Vertical Interconnection", 2005 IEEE. pp. 384-389.
S. W. Ricky Lee et al. "3D Stacked Flip Chip Packaging with Through Silicon Vias and Copper Plating or Conductive Adhesive Filling", 2005 IEEE, pp. 798-801.
Shen, Li-Cheng, et al.—"A Clamped Through Silicon Via (TSV) Interconnection for Stacked Chip Bonding Using Metal Cap on Pad and Metal col. Forming in Via," Proceedings of 2008 Electronic Components and Technology Conference, pp. 544-549.
Shi, Tailong, et al.—"First Demonstration of Panel Glass Fan-out (GFO) Packages for High I/O Density and High Frequency Multi-chip Integration," Proceedings of 2017 IEEE 67th Electronic Components and Technology Conference, May 30-Jun. 2, 2017, pp. 41-46.
Srinivasan, R., et al.—"Ultraviolet Laser Ablation of Organic Polymers," Chemical Reviews, 1989, vol. 89, No. 6, pp. 1303-1316.
Taiwan Office Action dated Oct. 27, 2020 for Application No. 108148588.
Trusheim, D. et al., Investigation of the Influence of Pulse Duration in Laser Processes for Solar Cells, Physics Procedia Dec. 2011, 278-285, 9 pages.
Wu et al., Microelect. Eng., vol. 87 2010, pp. 505-509.
Yu et al. "High Performance, High Density RDL for Advanced Packaging," 2018 IEEE 68th Electronic Components and Technology Conference, pp. 587-593, DOI 10.1109/ETCC.2018.0009.
Yu, Daquan—"Embedded Silicon Fan-out (eSiFO) Technology for Wafer-Level System Integration," Advances in Embedded and Fan-Out Wafer-Level Packaging Technologies, First Edition, edited by Beth Keser and Steffen Kroehnert, published 2019 by John Wiley & Sons, Inc., pp. 169-184.
Taiwan Office Action dated Sep. 22, 2022, for Taiwan Patent Application No. 111130159.
Japanese Office Action dated Feb. 28, 2023, for Japanese Patent Application No. 2021-574255.
Japanese Office Action issued to Patent Application No. 2021-574255 dated Sep. 12, 2023.
Office Action for Korean Application No. 10-2022-7001325 dated Nov. 16, 2023.

* cited by examiner

PLANARIZATION METHODS FOR PACKAGING SUBSTRATES

CROSS-REFERENCE TO RELATED APPLICATIONS

This application claims benefit of priority to Indian patent application number 201941023935, filed Jun. 17, 2019, which is herein incorporated by reference in its entirety.

BACKGROUND

Field

Embodiments of the present disclosure generally relate to planarization of surfaces on substrates and on layers formed on substrates. More specifically, embodiments of the present disclosure relate to planarization of surfaces on substrates for advanced packaging applications.

Description of the Related Art

Chemical mechanical planarization (CMP) is one process commonly used in the manufacture of high-density integrated circuits to planarize or polish a layer of material deposited on a substrate. Chemical mechanical planarization and polishing are useful in removing undesired surface topography and surface defects, such as rough surfaces, agglomerated materials, crystal lattice damage, scratches, and contaminated layers or materials. Chemical mechanical planarization is also useful in forming features on a substrate by removing excess material deposited to fill the features, and to provide an even surface for subsequent patterning operations.

In conventional CMP techniques, a substrate carrier or polishing head mounted on a carrier assembly positions a substrate secured therein in contact with a polishing pad mounted on a platen in a CMP apparatus. The carrier assembly provides a controllable load, i.e., pressure, on the substrate to urge the substrate against the polishing pad. An external driving force moves the polishing pad relative to the substrate. Thus, the CMP apparatus creates polishing or rubbing movement between the surface of the substrate and the polishing pad while dispersing a polishing composition, or slurry, to affect both chemical activity and mechanical activity.

Recently, polymeric materials have been increasingly used as material layers in the fabrication of integrated circuit chips due to the versatility of polymers for many advanced packaging applications. However, conventional CMP techniques are inefficient for polymeric material planarization due to the reduced removal rates associated with polymer chemistries. Thus, planarization of polymeric material layers becomes a limiting factor in the fabrication of advanced packaging structures.

Therefore, there is a need in the art for a method and apparatus for improved planarization of polymeric material surfaces.

SUMMARY

Embodiments of the present disclosure generally relate to planarization of surfaces on substrates and on layers formed on substrates. More specifically, embodiments of the present disclosure relate to planarization of surfaces on substrates for advanced packaging applications, such as surfaces of polymeric material layers.

In one embodiment, a method of substrate planarization is provided. The method includes positioning a substrate formed of a polymeric material into a polishing apparatus. A surface of the substrate is exposed to a first polishing process in which a grinding slurry is delivered to a polishing pad of a polishing apparatus. The grinding slurry includes colloidal particles having a grit size between about 1.2 μm and about 53 μm, a non-ionic polymer dispersion agent, and an aqueous solvent. The substrate surface is then exposed to a second polishing process in which a polishing slurry is delivered to the polishing pad of the polishing apparatus. The polishing slurry includes colloidal particles having a grit size between about 25 nm and about 500 nm.

BRIEF DESCRIPTION OF THE DRAWINGS

So that the manner in which the above-recited features of the present disclosure can be understood in detail, a more particular description of the implementations, briefly summarized above, may be had by reference to implementations, some of which are illustrated in the appended drawings. It is to be noted, however, that the appended drawings illustrate only typical implementations of this disclosure and are therefore not to be considered limiting of its scope, for the disclosure may admit to other equally effective implementations.

Figure 1:
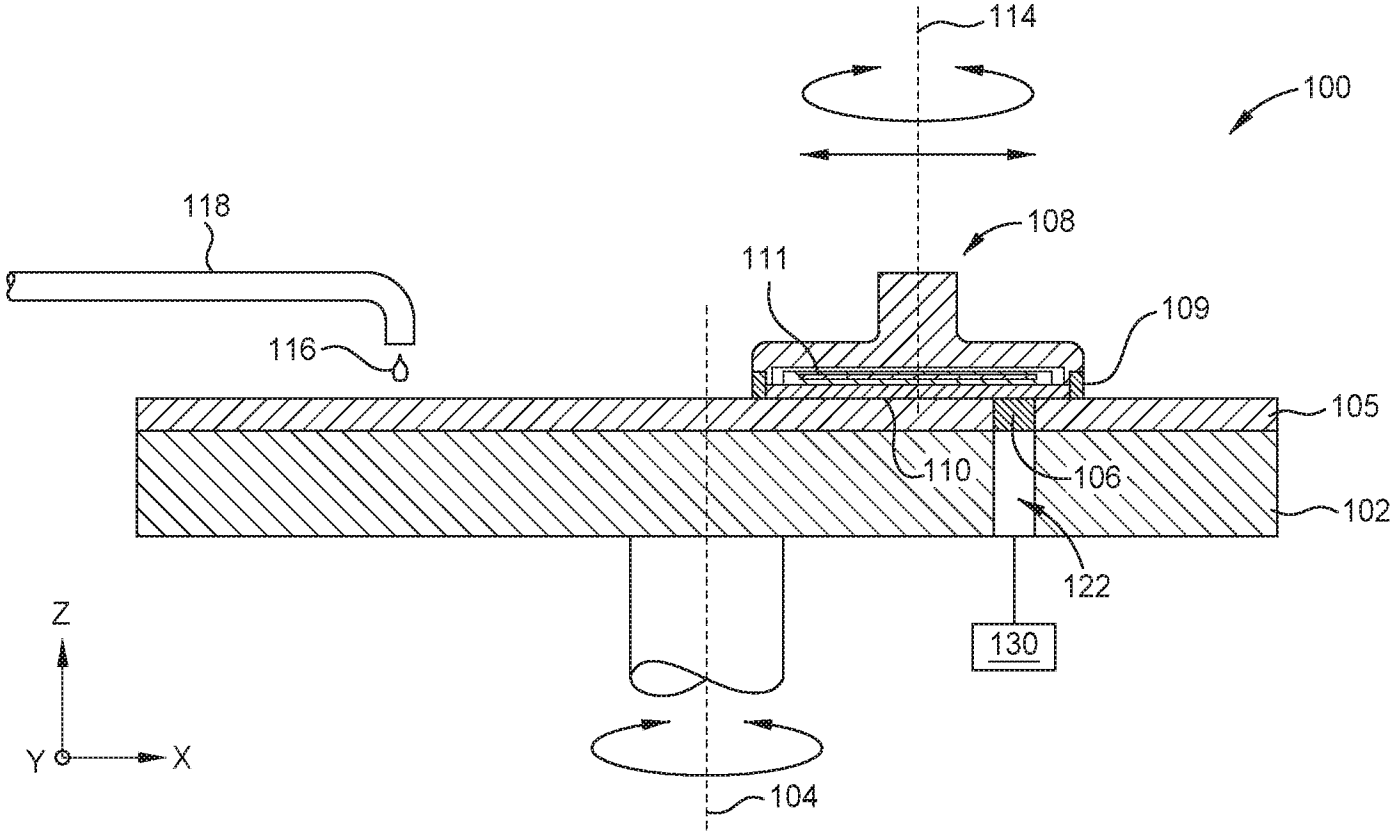
FIG. 1 illustrates a schematic sectional view of a polishing apparatus, according to an embodiment described herein.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

Embodiments of the present disclosure generally relate to planarization of surfaces on substrates and on layers formed on substrates. More specifically, embodiments of the present disclosure relate to planarization of surfaces on substrates for advanced packaging applications, such as surfaces of polymeric material layers. In one implementation, the method includes mechanically grinding a substrate surface against a polishing surface in the presence of a grinding slurry during a first polishing process to remove a portion of a material formed on the substrate; and then chemically mechanically polishing the substrate surface against the polishing surface in the presence of a polishing slurry during a second polishing process to reduce any roughness or unevenness caused by the first polishing process.

Certain details are set forth in the following description and in FIGS. 1 and 2 to provide a thorough understanding of various implementations of the disclosure. Other details describing well-known structures and systems often associated with substrate planarization and polishing are not set forth in the following disclosure to avoid unnecessarily obscuring the description of the various implementations.

Many of the details, dimensions, angles and other features shown in the Figures are merely illustrative of particular embodiments. Accordingly, other embodiments can have other details, components, dimensions, angles and features without departing from the spirit or scope of the present disclosure. In addition, further embodiments of the disclosure can be practiced without several of the details described below.

Embodiments described herein will be described below in reference to a planarization process that can be carried out using a chemical mechanical polishing system, such as a REFLEXION®, REFLEXION® LK™, REFLEXION® LK Prime™ and MIRRA MESA® polishing system available from Applied Materials, Inc. of Santa Clara, California Other tools capable of performing planarization and polishing processes may also be adapted to benefit from the implementations described herein. In addition, any system enabling the planarization processes described herein can be used to advantage. The apparatus description described herein is illustrative and should not be construed or interpreted as limiting the scope of the embodiments described herein.

FIG. 1 illustrates an exemplary chemical mechanical polishing apparatus 100 that may be used to planarize a material layer for advanced packaging applications, such as a polymeric substrate 110. Typically, a polishing pad 105 is secured to a platen 102 of the polishing apparatus 100 using an adhesive, such as a pressure sensitive adhesive, disposed between the polishing pad 105 and the platen 102. A substrate carrier 108, facing the platen 102 and the polishing pad 105 mounted thereon, includes a flexible diaphragm 111 configured to impose different pressures against different regions of the substrate 110 while urging the substrate 110 to be polished against a polishing surface of the polishing pad 105. The substrate carrier 108 further includes a carrier ring 109 surrounding the substrate 110.

During polishing, a downforce on the carrier ring 109 urges the carrier ring 109 against the polishing pad 105, thus preventing the substrate 110 from slipping from the substrate carrier 108. The substrate carrier 108 rotates about a carrier axis 114 while the flexible diaphragm 111 urges a desired surface of the substrate 110 against the polishing surface of the polishing pad 105. The platen 102 rotates about a platen axis 104 in an opposite rotational direction from the rotation direction of the substrate carrier 108 while the substrate carrier 108 sweeps back and forth from a center region of the platen 102 to an outer diameter of the platen 102 to, in part, reduce uneven wear of the polishing pad 105. As illustrated in FIG. 1, the platen 102 and the polishing pad 105 have a surface area that is greater than a surface area of the surface of the substrate 110 to be polished. However, in some polishing systems, the polishing pad 105 has a surface area that is less than the surface area of the surface of the substrate 110 to be polished. An endpoint detection system 130 directs light towards the substrate 110 through a platen opening 122 and further through an optically transparent window feature 106 of the polishing pad 105 disposed over the platen opening 122.

During polishing, a fluid 116 is introduced to the polishing pad 105 through a fluid dispenser 118 positioned over the platen 102. Typically, the fluid 116 is a polishing fluid, a polishing or grinding slurry, a cleaning fluid, or a combination thereof. In some embodiments, the fluid 116 is a polishing fluid comprising a pH adjuster and/or chemically active components, such as an oxidizing agent, to enable chemical mechanical polishing and planarization of the material surface of the substrate 110 in conjunction with the abrasives of the polishing pad 105.

Figure 2:
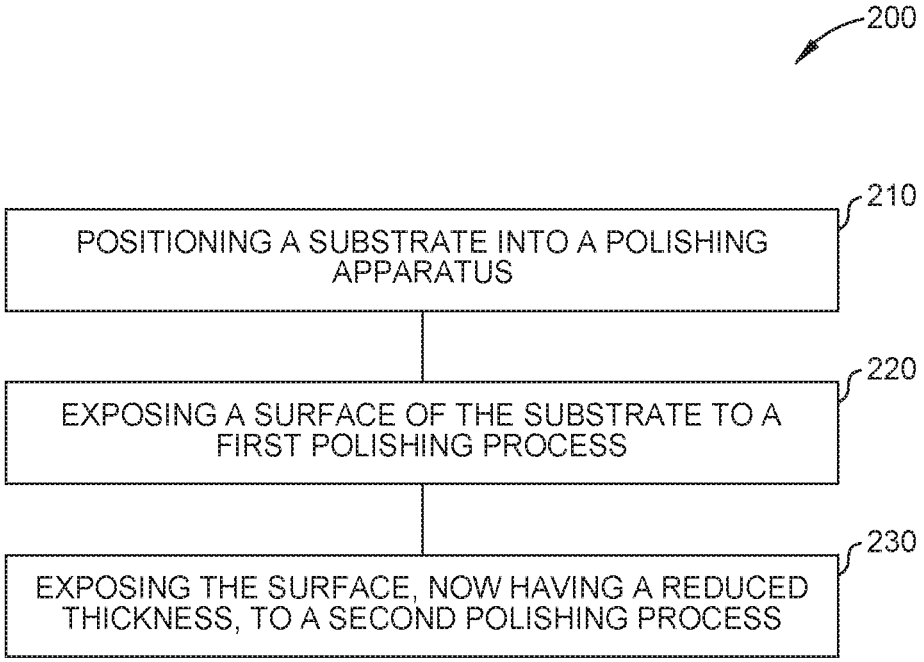
FIG. 2 illustrates a flow diagram of a process for substrate surface planarization, according to an embodiment described herein.

FIG. 2 is a flow diagram of a process 200 for planarizing a surface of a substrate, according to an embodiment described herein. The process 200 begins at operation 210 by positioning the substrate into a polishing apparatus, such as the polishing apparatus 100. Although described and depicted as a single layer, the substrate may include one or more material layers and/or structures formed thereon. For example, the substrate may include one or more metal layers, one or more dielectric layers, one or more interconnection structures, one or more redistribution structures, and/or other suitable layers and/or structures.

In one example, the substrate comprises a silicon material such as crystalline silicon (e.g., Si<100> or Si<111>), silicon oxide, strained silicon, silicon germanium, doped or undoped polysilicon, doped or undoped silicon wafers, patterned or non-patterned wafers, silicon on insulator (SOI), carbon doped silicon oxides, silicon nitride, doped silicon, and other suitable silicon materials. In one example, the substrate comprises a polymeric material such as polyimide, polyamide, parylene, silicone, epoxy, glass fiber-reinforced epoxy molding compound, epoxy resin with ceramic particles disposed therein, and other suitablee polymeric materials.

Further, the substrate may have various morphologies and dimensions. In one embodiment, the substrate is a circular substrate having a diameter between about 50 mm and about 500 mm, such as between about 100 mm and about 400 mm. For example, the substrate is a circular substrate having a diameter between about 150 mm and about 350 mm, such as between about 200 mm and about 300 mm. In some embodiments, the circular substrate has a diameter of about 200 mm, about 300 mm, or about 301 mm. In another example, the substrate is a polygonal substrate having a width between about 50 mm and about 650 mm, such as between about 100 mm and about 600 mm. For example, the substrate is a polygonal substrate having a width between about 200 mm and about 500 mm, such as between about 300 mm and about 400 mm. In some embodiments, the substrate has a panel shape with lateral dimensions up to about 500 mm and a thickness up to about 1 mm. In one embodiment, the substrate has a thickness between about 0.5 mm and about 1.5 mm. For example, the substrate is a circular substrate having a thickness between about 0.7 mm and about 1.4 mm, such as between about 1 mm and about 1.2 mm, such as about 1.1 mm. Other morphologies and dimensions are also contemplated.

At operation 220, the surface of the substrate to be planarized is exposed to a first polishing process in the polishing apparatus. The first polishing process is utilized to remove a desired thickness of material from the substrate. In one embodiment, the first polishing process is a mechanical grinding process utilizing a grinding slurry supplied to a polishing pad of the polishing apparatus. The grinding slurry includes colloidal particles dispersed in a solution comprising a dispersion agent. In one embodiment, the colloidal particles utilized in the grinding slurry are formed from an abrasive material such as silica ($SiO_2$), alumina ($AL_2O_3$), ceria ($CeO_2$), ferric oxide ($Fe_2O_3$), zirconia ($ZrO_2$), diamond (C), boron nitride (BN), and titania ($TiO_2$). In one embodiment, the colloidal particles are formed from silicon carbide (SiC).

The colloidal particles utilized for the first polishing process range in grit size from about 1 μm to about 55 μm, such as between about 1.2 μm and about 53 μm. For example, the colloidal particles have a grit size between about 1.2 μm and about 50 μm; between about 1.2 μm and about 40 μm; between about 1.2 μm and about 30 μm; between about 1.2 μm and about 20 μm; between about 1.2 μm and about 10 μm; between about 5 μm and about 50 μm; between about 5 μm and about 40 μm; between about 5 μm and about 30 μm; between about 5 μm and about 20 μm;

between about 5 μm and about 15 μm; between about 10 μm and about 55 μm; between about 20 μm and about 55 μm; between about 30 μm and about 55 μm; between about 40 μm and about 55 μm; between about 50 μm and about 55 μm. Increasing the grit size of the colloidal particles dispersed in the grinding slurry may increase the rate at which material may be removed from the substrate during the mechanical grinding process.

A weight percentage of the colloidal particles in the grinding slurry ranges from about 1% to about 25%, such as between about 2% and about 20%. For example, the weight percentage of the colloidal particles in the grinding slurry ranges from about 5 to about 15%; from about 6% to about 14%; from about 7% to about 13%; from about 8% to about 12%; from about 9% to about 11%. In one embodiment, the weight percentage of the colloidal particles in the grinding slurry is about 10%.

The dispersion agent in the grinding slurry is selected to increase the grinding efficiency of the colloidal particles. In one embodiment, the dispersion agent is a non-ionic polymer dispersant, including but not limited to polyvinyl alcohol (PVA), ethylene glycol (EG), glycerin, polyethylene glycol (PEG), polypropylene glycol (PPG), and polyvinylpyrrolidone (PVP). In one example, the dispersion agent is PEG with a molecular weight up to 2000. For example, the dispersion agent may be PEG 200, PEG 400, PEG 600, PEG 800, PEG 1000, PEG 1500, or PEG 2000. The dispersion agent is mixed with water or an aqueous solvent comprising water in a ratio between about 1:1 volume/volume (v/v) and about 1:4 (v/v) dispersion agent:water or aqueous solvent. For example, the dispersion agent is mixed with water or an aqueous solvent in a ratio of about 1:2 (v/v) dispersion agent:water or aqueous solvent.

In some embodiments, the grinding slurry further includes a pH adjustor, such as potassium hydroxide (KOH), tetramethylammonium hydroxide (TMAH), ammonium hydroxide ($NH_4OH$), nitric acid ($HNO_3$) or the like. The pH of the grinding slurry can be adjusted to a desired level by the addition of one or more pH adjustors.

During the first polishing process, the substrate surface and the polishing pad, such as polishing pad 105, are contacted at a pressure less than about 15 pounds per square inch (psi). Removal of a desired thickness of material from the substrate may be performed with a mechanical grinding process having a pressure of about 10 psi or less, for example, from about 1 psi to about 10 psi. In one aspect of the process, the substrate surface and polishing pad are contacted at a pressure between about 3 psi and about 10 psi, such as between about 5 psi and about 10 psi. Increasing the pressure at which the polishing pad and substrate surface contact generally increases the rate at which material may be removed from the substrate during the first polishing process.

In one embodiment, the platen is rotated at a velocity from about 50 rotations per minute (rpm) to about 100 rpm, and the substrate carrier is rotated at a velocity from about 50 rpm to about 100 rpm. In one aspect of the process, the platen is rotated at a velocity between about 70 rpm and about 90 rpm and the substrate carrier is rotated at a velocity between about 70 rpm and about 90 rpm.

Mechanical grinding of the substrate during the first polishing process as described above can achieve an improved removal rate of substrate material compared to conventional planarization and polishing process. For example, a removal rate of polyimide material of between about 6 μm/min and about 10 μm/min can be achieved. In another example, a removal rate of epoxy material of between about 6 μm/min and about 12 μm/min can be achieved. In yet another example, a removal rate of silicon material of between about 4 μm/min and about 6 μm/min can be achieved.

After completion of the first polishing process, the surface of the substrate, now having a reduced thickness, is exposed to a second polishing process in the same polishing apparatus at operation 230. The second polishing process is utilized to reduce any roughness or unevenness caused by the first polishing process. In one embodiment, the second polishing process is a CMP process utilizing a polishing slurry having finer colloidal particles than described with reference to the mechanical grinding process.

In one embodiment, the colloidal particles utilized for the second polishing process range in grit size from about 20 nm to about 500 nm, such as between about 25 nm and about 300 nm. For example, the colloidal particles have a grit size between about 25 nm and about 250 nm; between about 25 nm and about 200 nm; between about 25 nm and about 150 nm; between about 25 nm and about 100 nm; between about 25 nm and about 75 nm; between about 25 nm and about 50 nm; between about 100 nm and about 300 nm; between about 100 nm and about 250 nm; between about 100 nm and about 225 nm; between about 100 nm and about 200 nm; between about 100 nm and about 175 nm; between about 100 nm and about 150 nm; between about 100 nm and about 125 nm; between about 150 nm and about 250 nm; between about 150 nm and about 250 nm; between about 150 and about 225 nm; between about 150 nm and about 200 nm; between about 150 nm and about 175 nm. Increasing the grit size of the colloidal particles dispersed in the polishing slurry generally increases the rate at which material may be removed from the substrate during the second polishing process.

The colloidal particles utilized in the polishing slurry are formed from SiO2, $AL_2O_3$, $CeO_2$, $Fe_2O_3$, $ZrO_2$, C, BN, $TiO_2$, SiC, or the like. In one embodiment, the colloidal particles utilized in the polishing slurry are formed from the same material as the colloidal particles in the grinding slurry. In another embodiment, the colloidal particles utilized in the polishing slurry are formed from a different material than the colloidal particles in the grinding slurry.

A weight percentage of the colloidal particles in the polishing slurry ranges from about 1% to about 30%, such as between about 1% and about 25%. For example, the weight percentage of the colloidal particles in the grinding slurry ranges from about 1% to about 15%; from about 1% to about 10%; from about 1% to about 5%; from about 10% to about 30%; from about 10% to about 25%.

In some embodiments, the colloidal particles are dispersed in a solution including water, alumina ($Al_2O_3$), KOH, or the like. The polishing slurry may have a pH in a range of about 4 to about 10, such as between about 5 and about 10. For example, the polishing slurry has a pH in a range of about 7 to about 10, such as about 9. One or more pH adjustors may be added to the polishing slurry to adjust the pH of the polishing slurry to a desired level. For example, the pH of the polishing slurry may be adjusted by the addition of TMAH, $NH_4OH$, $HNO_3$, or the like.

During the second polishing process, the substrate surface and the polishing pad are contacted at a pressure less than about 15 psi. Smoothening of the substrate surface may be performed with a second polishing process having a pressure of about 10 psi or less, for example, from about 2 psi to about 10 psi. In one aspect of the process, the substrate surface and polishing pad are contacted at a pressure between about 3 psi and about 10 psi, such as between about 5 psi and about 10 psi.

In one embodiment, the platen is rotated during the second polishing process at a velocity from about 50 rpm to about 100 rpm, and the substrate carrier is rotated at a velocity from about 50 rpm to about 100 rpm. In one aspect of the process, the platen is rotated at a velocity between about 70 rpm and about 90 rpm and the substrate carrier is rotated at a velocity between about 70 rpm and about 90 rpm.

After the first and/or second polishing processes, the used slurries may be processed through a slurry management and recovery system for subsequent reuse. For example, the polishing apparatus may include a slurry recovery drain disposed below the polishing platen, such as platen 102. The slurry recovery drain may be fluidly coupled to a slurry recovery tank having one or more filters to separate reusable colloidal particles from the used grinding and polishing slurries based on size. Separated colloidal particles may then be washed and reintroduced into a fresh batch of slurry for further polishing processes.

The polishing and grinding slurries may be constantly circulated or agitated within the slurry management and recovery system. Constant circulation or agitation of the slurries prevents settling of the colloidal particles and maintains substantially uniform dispersion of the colloidal particles in the slurries. In one example, the slurry management and recovery system includes one or more vortex pumps to pump the slurries throughout the system. The open and spherical pumping channels reduce the risk of the colloidal particles clogging the pumps, thus enabling efficient circulation of the slurries within the slurry management and recovery system. In a further example, the slurry management and recovery system includes one or more slurry containment tanks having mixing apparatuses configured to constantly agitate stored slurries.

It has been observed that substrates planarized by the processes described herein have exhibited reduced topographical defects, improved profile uniformity, improved planarity, and improved substrate finish. Furthermore, the processes described herein provide improved removal rates of various materials utilized with substrates for advanced packaging applications, such as polymeric materials.

While the foregoing is directed to implementations of the present disclosure, other and further implementations of the disclosure may be devised without departing from the basic scope thereof, and the scope thereof is determined by the claims that follow.

The invention claimed is:

1. A method for planarization of a substrate, the method comprising:

positioning a substrate in a polishing apparatus, the substrate comprising a polymeric material;

exposing a polymer layer of a substrate surface of the substrate to a first polishing process, the first polishing process comprising:

delivering a grinding slurry to a polishing pad of the polishing apparatus, the grinding slurry comprising:

a first plurality of colloidal particles having a grit size between about 5 μm and about 53 μm, the first plurality of colloidal particles comprising a material selected from the group consisting of ferric oxide ($Fe_2O_3$), diamond (C), and boron nitride (BN);

a non-ionic polymer dispersion agent; and an aqueous solvent; and exposing the polymer layer of the substrate surface of the substrate to a second polishing process, the second polishing process comprising:

delivering a polishing slurry to the polishing pad of the polishing apparatus, the polishing slurry comprising:

a second plurality of colloidal particles having a grit size between about 25 nm and about 500 nm.

2. The method of claim 1, wherein a weight percentage of the first plurality of colloidal particles in the grinding slurry is between about 2% and about 20%.

3. The method of claim 1, wherein the non-ionic polymer dispersion agent is selected from the group consisting of polyvinyl alcohol, ethylene glycol, glycerin, polyethylene glycol, polypropylene glycol, and polyvinylpyrrolidone.

4. The method of claim 3, wherein the non-ionic polymer dispersion agent is mixed with the aqueous solvent in a ratio between about 1:1 and about 1:4 v/v dispersion agent: aqueous solvent.

5. The method of claim 1, wherein the polymeric material is selected from the group consisting of polyimide, polyamide, parylene, and silicone.

6. The method of claim 1, wherein the second plurality of colloidal particles have a grit size between about 25 nm and about 250 nm.

7. The method of claim 6, wherein the second plurality of colloidal particles comprises a material selected from the group consisting of silica, alumina, ceria, ferric oxide, zirconia, titania, and silicon carbide.

8. The method of claim 1, wherein the second plurality of colloidal particles are formed from a different material than the material of the first plurality of colloidal particles.

9. The method of claim 8, wherein a weight percentage of the second plurality of colloidal particles in the polishing slurry is between about 1% and about 25%.

10. The method of claim 9, wherein the polishing slurry further comprises one or more of water, alumina, and potassium hydroxide.

11. The method of claim 1, wherein the non-ionic polymer dispersion agent is selected from the group consisting of polyvinyl alcohol, ethylene glycol, glycerin, polyethylene glycol, and polypropylene glycol.

12. A method for planarization of a substrate, the method comprising:

exposing a polymer layer of a substrate to a first polishing process, the first polishing process comprising:

polishing the substrate with a grinding slurry and a polishing pad, the grinding slurry comprising a first plurality of colloidal particles having a grit size between about 5 μm and about 55 μm, the first plurality of colloidal particles comprising ferric oxide ($Fe_2O_3$), diamond (C), or boron nitride (BN);

exposing the polymer layer of the substrate to a second polishing process, the second polishing process comprising:

polishing the substrate with a polishing slurry and the polishing pad, the polishing slurry comprising a second plurality of colloidal particles having a grit size between about 20 nm and about 500 nm.

13. The method of claim 12, wherein a weight percentage of the first plurality of colloidal particles in the grinding slurry is between about 2% and about 20%.

14. The method of claim 13, wherein the grinding slurry further comprises a non-ionic polymer dispersion agent selected from the group consisting of polyvinyl alcohol, ethylene glycol, glycerin, polyethylene glycol, polypropylene glycol, and polyvinylpyrrolidone.

15. The method of claim 12, wherein the second plurality of colloidal particles comprises a material selected from the group consisting of silica, alumina, ceria, ferric oxide, zirconia, diamond, boron nitride, titania, and silicon carbide.

16. The method of claim 12, wherein the second plurality of colloidal particles comprises a different material than the material of the first plurality of colloidal particles.

17. The method of claim 12, wherein a weight percentage of the second plurality of colloidal particles in the polishing slurry is between about 1% and about 25%.

18. The method of claim 12, wherein the substrate is a polymeric substrate comprising polyimide, polyamide, parylene, or silicone.

19. The method of claim 12, wherein the grinding slurry further comprises a non-ionic polymer dispersion agent selected from the group consisting of polyvinyl alcohol, ethylene glycol, glycerin, polyethylene glycol, and polypropylene glycol.

20. A method for planarization of a substrate, the method comprising:

positioning a substrate in a polishing apparatus, the substrate comprising a polymeric material selected from the group consisting of polyimide, polyamide, parylene, and silicone;

exposing a polymer layer of a substrate surface of the substrate to a first polishing process, the first polishing process comprising:

delivering a grinding slurry to a polishing pad of the polishing apparatus, the polishing pad pressed against the substrate surface and rotated at a velocity between about 50 rotations per minute and about 100 rotations per minute, the grinding slurry comprising:

a first plurality of colloidal particles having a grit size between about 5 μm and about 20 μm and a weight percentage between about 2% and about 20%, the first plurality of colloidal particles comprising a material selected from the group consisting of ferric oxide ($Fe_2O_3$), diamond (C), and boron nitride (BN);

a non-ionic polymer dispersion agent comprising polyvinylpyrrolidone; and an aqueous solvent, wherein the non-ionic polymer dispersion agent is mixed with the aqueous solvent in a ratio of about 1:1 v/v dispersion agent: aqueous solvent;

exposing the polymer layer of the substrate surface of the substrate to a second polishing process, the second polishing process comprising:

delivering a polishing slurry to the polishing pad of the polishing apparatus, the polishing slurry comprising:

a second plurality of colloidal particles having a grit size between about 25 nm and about 200 nm and a weight percentage between about 1% and about 25%, wherein the second plurality of colloidal particles are formed from a different material than the material of the first plurality of colloidal particles; and recycling the first and second pluralities of colloidal particles to reform the grind slurry and the polishing slurry.

* * * * *